US005957709A

United States Patent [19]

Heimueller et al.

[11] Patent Number: 5,957,709

[45] Date of Patent: Sep. 28, 1999

[54] ELECTRICAL CONNECTOR COUPLING

[75] Inventors: Hans-Jost Heimueller, Dudenhofen; Martin Straeb, Diessen, both of Germany

[73] Assignee: Siemens Aktiengesellschaft, Munich, Germany

[21] Appl. No.: 08/933,589

[22] Filed: Sep. 19, 1997

[30] Foreign Application Priority Data

Sep. 19, 1996 [DE] Germany ..... 196 38 499

[51] Int. Cl.[6] ..... H01R 13/62

[52] U.S. Cl. ..... 439/157

[58] Field of Search ..... 439/157, 310, 439/347, 352

[56] References Cited

U.S. PATENT DOCUMENTS 5,435,742 7/1995 Cecil, Jr. ..... 439/347

FOREIGN PATENT DOCUMENTS

3730020C1 9/1988 Germany .
3645179C2 2/1992 Germany .
19604862A1 8/1996 Germany .
196 38 499 C1 1/1998 Germany .

*Primary Examiner*—Neil Abrams
*Assistant Examiner*—Barry M.L. Standig
*Attorney, Agent, or Firm*—Herbert L. Lerner; Laurence A. Greenberg

[57] ABSTRACT

A modular electrical connector coupling has a plurality of connector parts which can be plugged into one another. One of the connector parts has an enveloping housing with double-walled side walls and latching hooks for retaining the other connector parts. A locking slide is inserted into the gap formed by the double-walled side walls and prevents the latching hooks from springing back.

18 Claims, 5 Drawing Sheets

ELECTRICAL CONNECTOR COUPLING

BACKGROUND OF THE INVENTION

Field of the Invention

The invention relates to an electrical connector coupling having a first connector part, which has a box-shaped enveloping housing, and having at least a second connector part, which can be plugged into the enveloping housing. The coupling further includes a locking slide, which secures the at least two connector parts against undesired separation, which is approximately U-shaped, which can be moved perpendicularly to the plug-in direction into one of the connector parts and which, upon proper assembly of the at least two connector parts, can be pushed into a given end position.

Electrical connector couplings of this generic type are described, for example, in German patents DE 37 30 020 C1 and DE 36 45 179 C2. The connector coupling has two connector parts which are to be connected to one another and are secured against being drawn apart accidentally by a locking slide which is guided via a sliding guide. Moreover, the locking slide of the prior art also serves as a plugging and withdrawing aid in mating the two connector parts.

Those prior art connector couplings do not permit a plurality of connector parts to be inserted into another connector part. A modular configuration such as is desired, in particular, with motor vehicle plug-and-socket connections, is not possible with those prior art connector couplings. The prior art connector couplings, therefore, leave much to be desired with regard to flexibility.

SUMMARY OF THE INVENTION

It is accordingly an object of the invention to provide an electrical connector coupling, which overcomes the above-mentioned disadvantages of the heretofore-known devices and methods of this general type, which permits a modular design and modular intermating of the individual connector parts, which is of relatively compact design, and which is easy to produce.

With the foregoing and other objects in view there is provided, in accordance with the invention, an electrical connector coupling, comprising:

a first connector part having a box-shaped enveloping housing and a second connector part to be plugged into the enveloping housing along a given plug-in direction;

the enveloping housing having two mutually opposite double-walled side walls, each of the side walls having an outer wall and an inner wall spaced apart from the outer wall and forming a gap therebetween, each of the inner walls carrying a plurality of latching hooks which are deflectable in a direction towards the respectively associated outer wall when the second connector part is inserted into the enveloping housing;

a substantially U-shaped locking slide for securing the first and second connector parts against accidental separation, the locking slide having two mutually opposite side wall's adapted to be inserted perpendicularly to the plug-in direction into the gaps formed in the enveloping housing, the locking slide thereby assuming an intermediate position along an insertion path thereof and, upon further insertion, an end position in which the locking slide secures the first and second connector parts in a proper assembly position thereof;

the mutually opposite side walls of the locking slide having cutouts formed in respective inner wall surfaces thereof, the cutouts, in the intermediate position of the locking slide, coming to lie behind the latching hooks for permitting a deflection of the latching hooks, and the side walls of the locking slide blocking the deflection of the latching hooks in the end position thereof.

In essence, the invention is based on the fact that the enveloping housing has two mutually opposite, double-walled side walls which each have an outer wall and an inner wall spaced from the outer wall and thereby forming a gap; the two inner walls each have latching hooks which can be deflected in the direction of the associated outer wall when a second connector part is inserted into the enveloping housing; the locking slide can be inserted with its two opposite side walls into the gaps of the enveloping housing and has on its opposite inner surfaces cutouts, which come to lie in a first position (the intermediate position) of the locking slide behind the latching hooks and permit deflection of the latching hooks, as well as wall sections which come to lie in the end position of the locking slide behind the latching hooks and they lock the latching hooks against deflection.

The basis for the electrical connector coupling according to the invention is formed by the box-shaped enveloping housing of the first connector part, which can always be of the same configuration for connector couplings of different configuration. It is possible for one or more connector parts to be inserted into this enveloping housing, in order to ensure an electrical connection between the contact elements of the individual connector parts. In principle, the enveloping housing contains a locking slide which, owing to its overall size, can be formed with a flat guide angle with a large displacement path. For this purpose, this U-shaped locking slide has side walls which, in terms of height and length, correspond approximately to the dimensions of the side walls of the enveloping housing, thus making possible the large displacement path of a preferably designed sliding guide. This large displacement path advantageously permits the locking slide to be drawn in exactly in parallel between the double-walled side walls of the enveloping housing.

The connector parts to be plugged into the enveloping housing are preferably "clipped in" from above. Because of the cooperation of the latching hooks on the enveloping housing and of the locking slide, this "clipping in" is possible only with the sliding guide open, that is to say only when the locking slide is in the intermediate position, which is preferably latchable. In this position of the locking slide, the latching hooks integrally formed on the enveloping housing can spring back when the connector parts are inserted into the enveloping housing from above. Specifically, the cutouts are seated exactly behind the latching hooks of the enveloping housing only in this position of the locking slide. If, by contrast, the locking slide is brought into its end position, thicker wall segments of the locking slide grip the latching hooks on the enveloping housing from behind, with the result that the hooks can no longer spring to the outer wall of the side wall of the enveloping housing. When the connector coupling is properly assembled, the latching hooks hook in the above-mentioned first position (intermediate position) of the locking slide behind latching edges of the plugged-in connector parts. Subsequently, the locking slide is brought into its end position. As a result, the latching hooks hook permanently on the latching edges of the inserted connector part, and thus protect these connector parts from being accidentally and undesirably withdrawn.

In a particular embodiment of the invention, the latching hooks on the enveloping housing can be configured such that it is virtually impossible to withdraw the connector parts inserted into the enveloping housing. In this case, the latching hooks have beveled surfaces which permit the connector parts to be pushed into the enveloping housing. In addition, the latching hooks have surfaces which are arranged orthogonally to the plug-in direction and hook to the above-mentioned latching edges of the connector parts. For this purpose, the latching edges likewise have a plane which is orthogonal to the plug-in direction. Undesired withdrawal of the connector parts is no longer possible, since the multiplicity of latching hooks arranged on the enveloping housing no longer permit the connector part to be withdrawn from the enveloping housing, unless the locking slide is extracted from the enveloping housing and a suitable tool is used to push the multiplicity of latching hooks outwards so that the connector part is released.

In accordance with an alternative feature of the invention, the latching hooks are formed with a first surface which is beveled in a direction of the second connector part and a second beveled surface. This makes it possible to remove the connector part from the housing when a strong pull is exerted on the connector part inserted into the enveloping housing in the opposite direction to the plug-in direction.

In accordance with an added feature of the invention, the cutouts on the inner surfaces of the locking slide are obliquely extending notches at which the side walls of the locking slide have a reduced thickness. As a result, the side walls of the locking slide can be designed with solid walls. Although it is possible in principle to push the locking slide into the double-walled side walls of the enveloping housing in any desired way, the obvious approach is to use a sliding guide for this purpose. For the sliding guide, it is possible to arrange in the side walls of the locking slide sliding guide slots or sliding guide grooves which cooperate with suitable pins which are arranged on the connector part which has the enveloping housing. Such a sliding guide also serves as a plugging and withdrawing aid.

The locking slide preferably has latching elements by means of which the locking slide latches in the intermediate position and in the end position, i.e., where it is pushed fully into the enveloping housing. In the first position, the cutouts arranged on the locking slide grip the latching hooks of the enveloping housing from behind, with the result that the latching hooks can spring back and the insertion of the connector parts into the enveloping housing is thereby ensured. In one embodiment of the invention, the latching of the locking slide is achieved by virtue of the fact that the two side walls of the locking slide each have a latching hook in the middle which can engage in corresponding latching openings in the side walls of the enveloping housing in the two sliding positions.

In accordance with an additional feature of the invention, the enveloping housing of the first connector part is mounted on a collared connecting element which is provided with a base plate from which a collar projects. The above-mentioned pins for the sliding guide of the locking slide can be formed on the outer wall of this collar. The contact elements, for example contact pins or contact tubes provided for the plug-and-socket connection, are arranged inside the collar. Moreover, projecting sword elements are preferably located inside the collar. These serve to protect the contact pins and/or contact tubes inside the collar. The sword elements thereby project beyond the contact pins/contact tubes and render it impossible, or at least difficult, for the contact elements inside the collar to bend when a connector part is inserted.

In accordance with a further feature of the invention, so-called tension springs are disposed inside the collared connecting element. The springs ensure an additional bracing of the connector part inserted into the enveloping housing. As a result, the mechanical stability of the entire connector coupling is increased. In order to prevent faulty assembly of the connector coupling, it is expedient to provide the above-mentioned "clipping of the connector modules" into the enveloping housing with a code. If one of the connector modules is not correctly "clipped in" when the connector coupling is assembled, the locking slide is blocked. To be precise, the wrongly assembled connector parts ensure the latching catches are deflected, and thus a rear insertion of the locking slide. As a result, the latter can no longer be moved.

Other features which are considered as characteristic for the invention are set forth in the appended claims.

Although the invention is illustrated and described herein as embodied in an electrical connector coupling, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
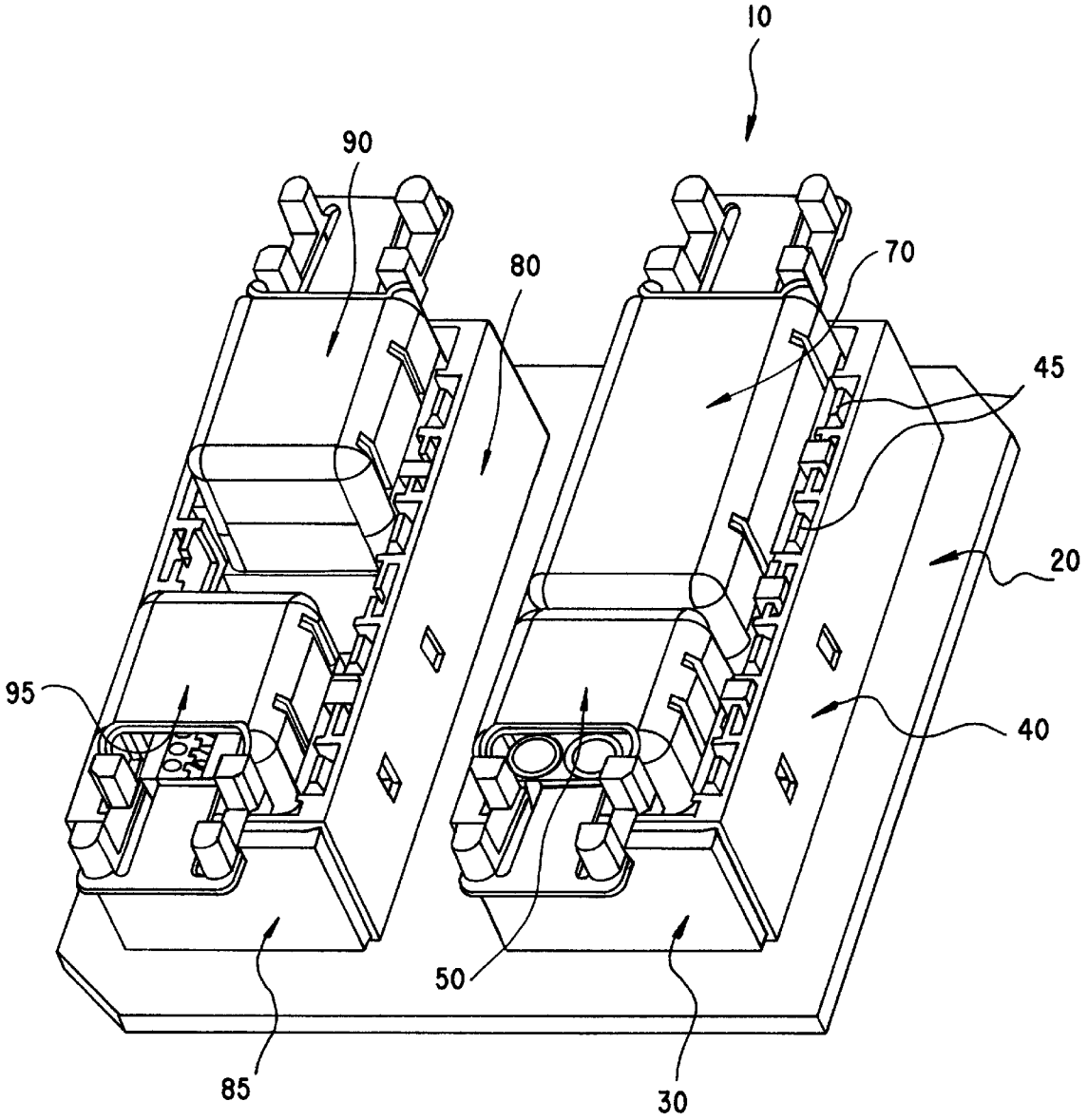
FIG. 1 is a perspective view of a completely assembled modular connector coupling according to the invention.

Referring now to the figures of the drawing, in which like reference numerals are used for like members throughout, there is seen an exemplary embodiment of an electrical connector coupling 10 such as can be used, for example, in motor vehicles to conductively connect different electrical components. The connector coupling serves, for example, to connect various electrical components of the motor vehicle to a control device of the motor vehicle. For this purpose, the connector coupling 10 has a first connector part which, in the illustrated exemplary embodiment, essentially comprises a collared connecting element 20 and a mounted enveloping housing 40. A multiplicity of contact elements are disposed inside the enveloping housing 40, for example contact pins and/or contact tubes. The latter make contact with second connector parts 50, 70, which likewise contain contact pins and/or contact tubes, provided these connector parts 50, 70 are inserted properly into the enveloping housing 40 of the first connector part.

In the exemplary embodiment illustrated in FIG. 1, two connector parts 50,70 are inserted into the enveloping housing 40. By way of example, the connector part 50 may be the connection to an ignition module, and the connector part 70 may be the connection to an engine control module.

Seated on the collared connecting element 20 is a further enveloping housing 80 which, like the enveloping housing 40, is plugged on a collar (not visible in FIG. 1) of the collared connecting element 20. Further connector parts 90, 95 are inserted into this second enveloping housing 80. The purpose of this is to make an electrical connection to further modules of the motor vehicle. Locking slides 30, 85 are pushed into the two enveloping housings 40, 80 in an orthogonal direction to the plug-in direction of the connector coupling. The locking slides 30, 85 are essentially U-shaped. The side walls of the locking slides 30, 85 run into gaps in the side walls, which are of double-walled design, of the enveloping housings 40, 80. The locking slide 30, 85, which is pushed fully into the respective enveloping housing 40, 80, has the effect that latching hooks 45 hook to the enveloping housing 40, 80 behind latching edges of the connector parts 50, 70 and 90, 95 respectively, and ensure a reliable connection of the connector coupling 10.

The configuration of the individual components of the connector coupling 10 represented in FIG. 1 will now be explained with particular reference to FIGS. 2–7.

Figure 2:
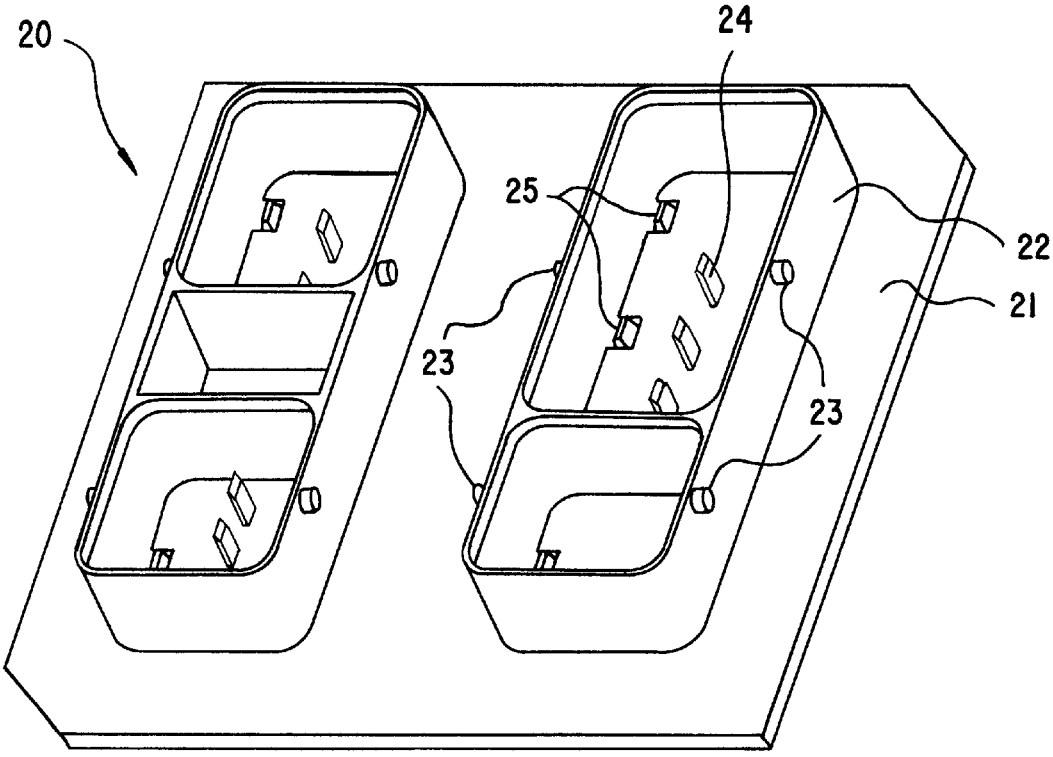
FIG. 2 is a perspective view of a collared connecting element of the connector coupling of FIG. 1.

The collared connecting element 20 of the connector coupling of FIG. 1 is shown in FIG. 2 in a perspective view. The collared connecting element 20 has a flat base plate 21 from which there project upwards two collars 22 in the shape of a rectangle. Each collar 22 can be subdivided into a plurality of chambers. The collar 22 represented on the right in FIG. 2 has a single partition for forming two chambers of the collared connecting element 2, while the collar projecting on the left has two partitions for forming three chambers. The arrangement of the partitions is selected such that the connector parts 50, 70, 90, 95 shown in FIG. 1 can be plugged into the collars 22.

The contact elements required for the plug-and-socket connection are located inside each collar 22. The contact elements are contact pins and/or contact tubes which, however, are not represented in FIG. 2 for the purpose of clarity. Arranged inside the collar 22 are upright sword elements 24, the purpose being to prevent bending of the contact elements located inside the collar 22. Additionally, tension springs 25, which are likewise formed like swords, project inside the collar 22. By contrast with the sword elements 24 arranged in the middle, these tension springs 25 are arranged at the edge of the collar 22 and spring in the direction of the outer wall of the collar 22 when connector parts are plugged into the chambers of the collar 22. This ensures that the inserted connector part is held in a clamped fashion, and the mechanical stability of the connector coupling is thereby increased.

Figure 3:
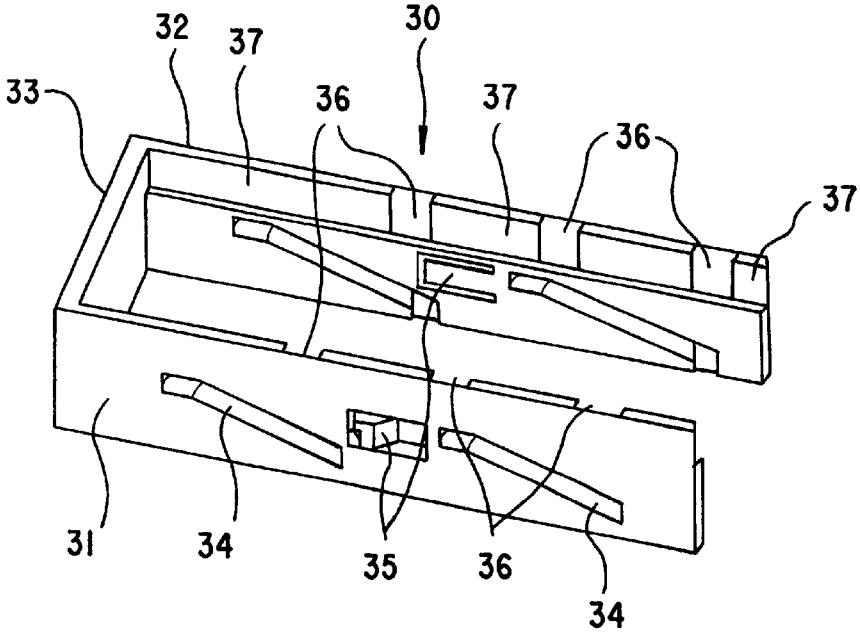
FIG. 3 is a perspective view of one of the two locking slides of FIG. 1.

As may be seen in FIG. 2, there are arranged on each of the two longitudinal walls of the collar 22 two pins 23 which are required for a sliding guide of the locking slide as it is represented in FIG. 3.

Figure 4:
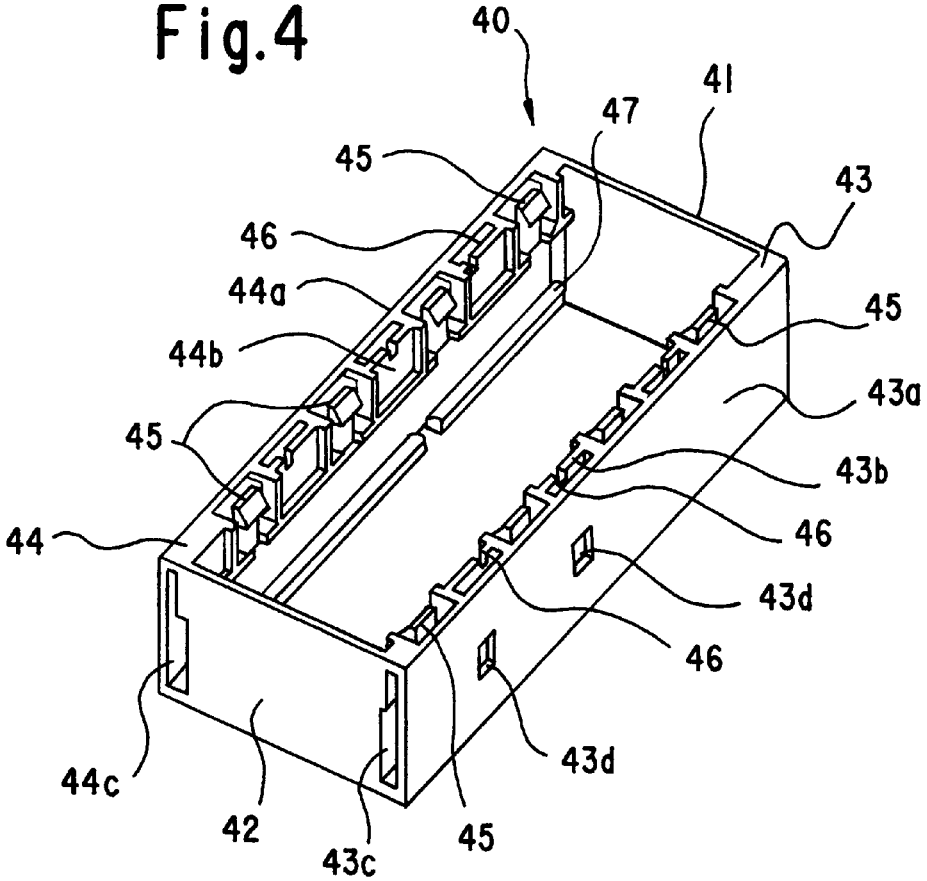
FIG. 4 is a perspective view of the two enveloping housings of the connector of FIG. 1.

The locking slide 30 shown in FIG. 3 is U-shaped with two opposite side walls 31, 32 and an end wall 33 connecting the two side walls 31, 32. The height of these side walls 31, 32 and of the end wall 33 corresponds largely to the height of the enveloping housing 40 (FIG. 4). The two side walls 31, 32 of the locking slide 30 each have two oblique sliding guide slots or sliding guide grooves 34, which cooperate with the pins 23 explained in conjunction with FIG. 2. Moreover, the two side walls 31, 32 of the locking slide 30 are provided approximately in the middle with latching hooks 35 which cooperate with latching openings 43*d* in the side walls 43, 44 of the enveloping housing 40 and which cause the locking slide 30 to lock in a first position and in an end position when the locking slide 30 is pushed into the enveloping housing 40.

On its two opposite side walls 31, 32, the locking slide 30 has cutouts 36 in its upper region. In the present exemplary embodiment, these cutouts 36 are notches in the mutually opposite inner surfaces of the side walls 31, 32. In the exemplary embodiment represented in FIG. 3, each of the two side walls 31, 32 has three such cutouts 36 which, however, are arranged offset relative to one another. To the left and right of these cutouts 36, each side wall 31, 32 has wall sections 37 with a larger cross section. These cutouts 36 and wall sections 37 cooperate with the latching hooks 45, already briefly mentioned, on the enveloping housing 40 in a way yet to be explained.

Referring now to FIG. 4, the enveloping housing 40 is box-shaped. The enveloping housing 40 has two mutually opposite narrow end walls 41, 42 and two mutually opposite longer side walls 43, 44, which connect the end walls 41, 42. The side walls 43, 44 are double-walled. Each of the two side walls 43, 44 has an outer wall 43*a*, 44*a* and an inner wall 43*b*, 44*b*, which is spaced therefrom and thereby forms a gap. As shown by the exemplary embodiment of the enveloping housing 40, the outer walls 43*a*, 44*a* of the enveloping housing 40 extend over the entire height of the enveloping housing 40, while the two inner walls 43*b*, 44*b* project downwards approximately halfway, roughly from the upper edge of the side walls 43, 44. These inner walls 43*b*, 44*b* are provided with a multiplicity of latching hooks 45, which extend upwards and can spring outwards in the non-assembled state of the enveloping housing 40, that is to say in the direction of the respective outer wall 43*a*, 44*a*.

Figure 4A:
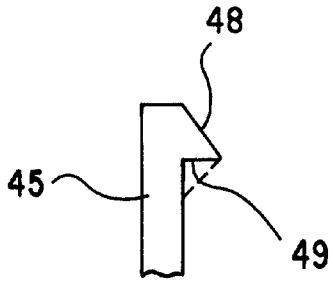
FIG. 4A is a partial, side elevational view of a latching hook of the housing of FIG. 4.

The cross-sectional shape of the latching hooks 45 is sketched in the detailed representation of FIG. 4A. The latching hook 45 has a shank which extends vertically upwards and whose upper end is designed in the shape of a hook. Here, the latching hook 45 has a surface 48 which is arranged obliquely relative to the plug-in direction of the connector coupling and on which a connector part can slide along downwards. This oblique surface 48 springs back either orthogonally or obliquely relative to the plug-in direction of the connector coupling, as is represented by dashes in the detailed representation of FIG. 4. If the latching hook 45 is designed as drawn in the detailed representation of FIG. 4A by means of continuous lines, after the latching of the latching hook 45 a connector part plugged into the enveloping housing 40 can no longer be removed without the aid of tools. If, by contrast, the surface 49 is oblique, as represented by dashes, the connector part inserted into the enveloping housing 40 can be removed by the appropriate expenditure of force if the locking slide is located in its pre-latching position, that is to say in the first position.

As is further to be seen from the perspective view of the enveloping housing 40 in FIG. 4, the end wall 42 has two slots 43*c*, 44*c*, which are parallel to one another and arranged at the edges of the end wall 42. The locking slide 30 can be pushed into these slots 43*c*, 44*c*. In this case, the side walls 31, 32 run between the double-walled side walls 43, 44 of the enveloping housing 40. The side walls 31, 32 of the locking slide 30 run on a rail 47 which is arranged at the bottom on the side walls 43, 44 of the enveloping housing 40.

The locking slide 30 is in its pre-latching position when the latching hooks 35 of the locking slide 30 hook into the two latching openings 43*d* facing the end wall 42. The cutouts 36 in the side walls 31, 32 of the locking slide 30 come to lie in this slide position exactly behind the latching hooks 45 of the enveloping housing 40. In this slide position, the latching hooks 45 can be deflected rearwards, with the result that the connector parts 50, 70 and 90, 95, respectively, can be pushed into the enveloping housing 40 or 80, respectively. While the connector parts of the enveloping housing 40 are being pushed in, the connector parts 50, 70 and 90, 95, respectively, press with their housings against the surfaces 48 of the latching hooks 45, as a result of which the latching hooks 45 are deflected rearwards. If the connector parts 50, 70 and 90, 95, respectively, are then inserted completely into the enveloping housing 40, the latching hooks 45 snap back onto latching edges of the inserted connector parts. Subsequently, the locking slide 30 is pushed completely into the enveloping housing 40, as is represented in FIG. 1, the latching hooks 35 of the locking slide 30 locking home in the second latching openings 43*d*. In this end position of the locking slide 30, the thicker wall sections 37 grip the latching hooks 45 from behind, with the result that the latter can no longer be deflected rearwards and it is impossible to remove the connector parts plugged into the enveloping housing 40.

Figure 5A:
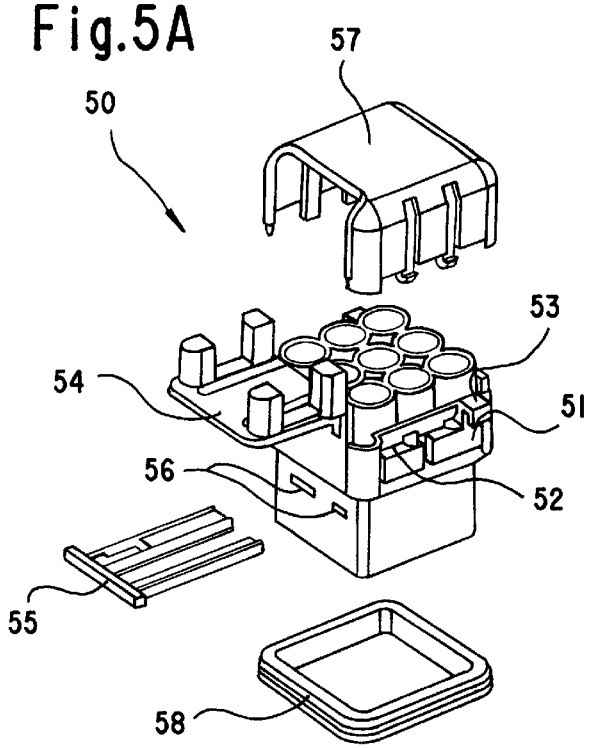
FIG. 5A is an exploded, perspective view of a connector part to be inserted into the enveloping housing.
Figure 5B:
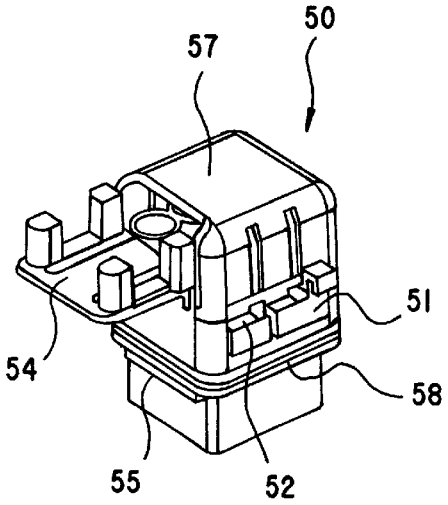
FIG. 5B is a perspective view of the connector part of FIG. 5A in the assembled state.

FIGS. 5A and 5B show the connector part 50 in the exploded and in the assembled state. The connector part 50 serves, for example, as a connection for an ignition module in a motor vehicle. The connector part 50 has a one-part socket housing 51 on which latching edges 52 are provided for engaging the latching hooks 45 of the enveloping housing 40. Located on the socket housing 51 is a stable cable tie 54 which permits a connecting lead to be fixed once or twice. The contact elements, which are plugged into the socket housing 51 (and are not represented in FIG. 5 for the sake of clarity) latch primarily inside the socket housing 51 in a way known per se, and are locked in a secondary fashion independently of this primary latching by a transversely running slide 55. To remove the contact elements from the socket housing 51, the slide 55 must be removed, and a non-illustrated primary latching lance must be pressed away by means of a suitable auxiliary tool. The contact elements can then be withdrawn from the socket housing. The socket housing 51 has a sealing element which is realized in the present exemplary embodiment as a radial seal 58. This radial seal 58 is pushed from below over the socket housing 51, which is of box-shaped configuration. A covering cap 27, which can be clipped onto the socket housing 51 is provided on the opposite side, that is to say on the top side of the socket housing 51.

Figure 6:
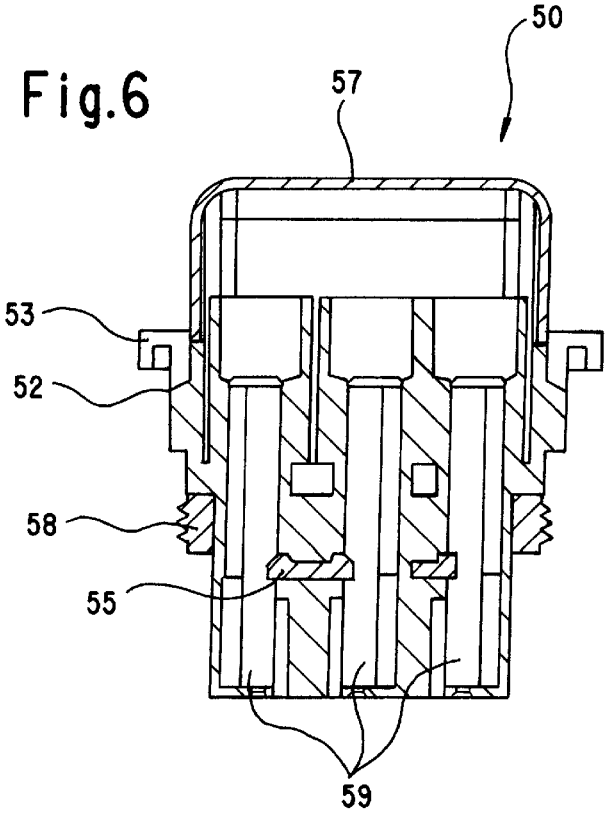
FIG. 6 is a longitudinal section view of the connector part of FIG. 5B.

The connector part 50 of FIG. 5B is represented in a sectional view in FIG. 6. In the exemplary embodiment shown, the socket housing 51 has three juxtaposed contact cavities for holding contact elements, for example contact tubes. As FIG. 6 shows particularly clearly, the socket housing 51 has hooks 53 in the region of the latching edges 52. These hooks 53 are integrally formed in one piece approximately in the shape of a U on the outer wall of the socket housing and serve the purpose of engaging in corresponding openings or slots on the enveloping housing. These openings or recesses are designated in FIG. 4 by the designation 46. Faulty assembly of the connector coupling can be avoided by means of these openings 46 and hooks 53. Specifically, if the hook 53 of the socket housing 51 cannot be pushed or clipped into an opening 46 of the enveloping housing 40, the locking slide 30 becomes blocked. To be precise, the enveloping housings 40 fitted with "wrong" connector parts ensure that the latching hooks 45 are deflected and thus undercut the locking slide 30, as a result of which the latter can no longer be moved. Faulty assembly of the enveloping housing 40 can therefore be effectively avoided.

Figure 7:
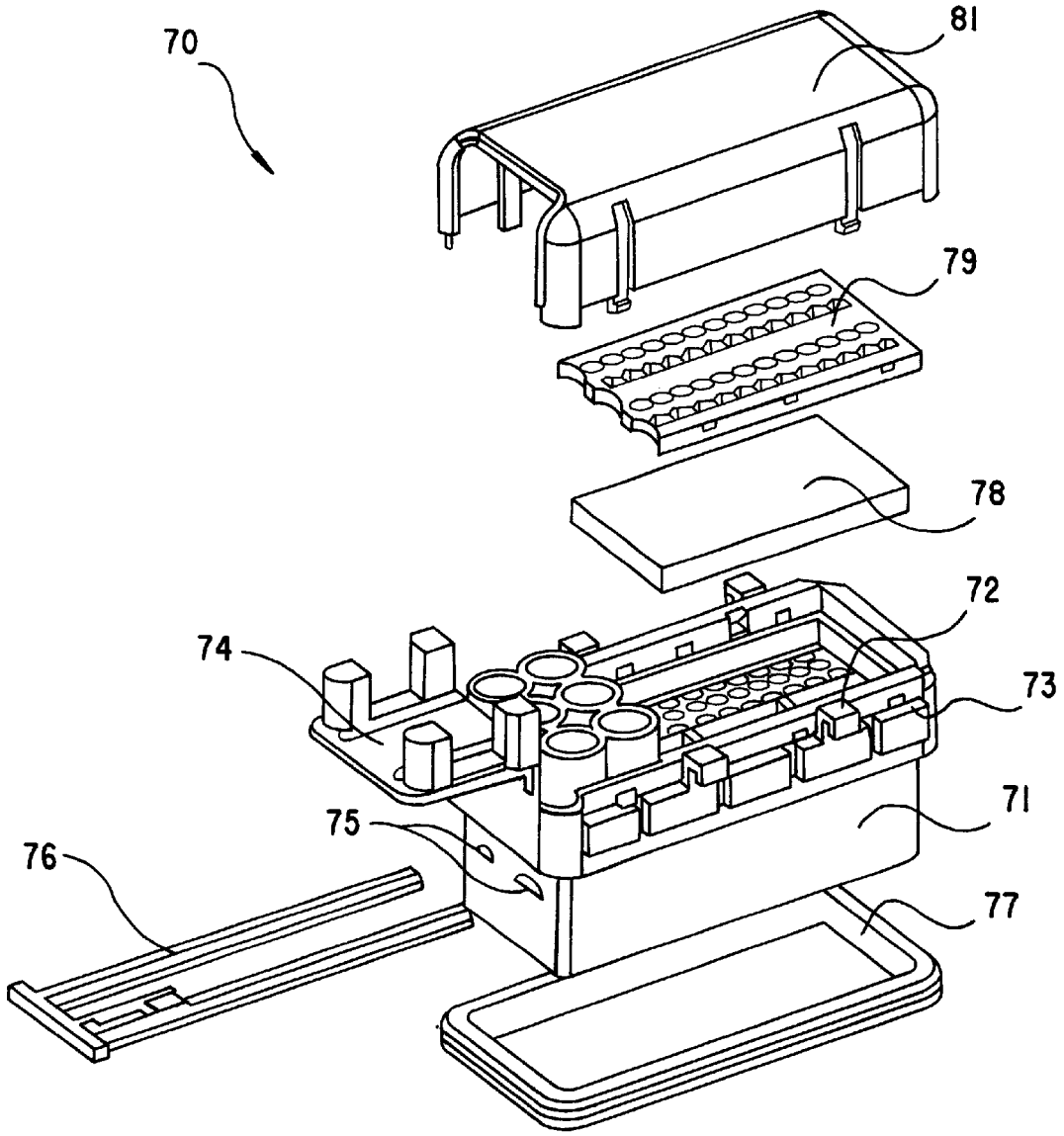
FIG. 7 is an exploded, perspective view of a further connector part, which is inserted in FIG. 1 into one of the enveloping housings of the connector coupling.

The further connector part 70 already known from FIG. 1 is shown in an exploded representation in FIG. 7. This connector part 70 serves, for example, as a connection for an engine module in the motor vehicle. The connector part 70 has a socket housing 71 which, in the exemplary embodiment represented, is approximately twice as large as the connector part 50 presented in conjunction with FIG. 5. The functional design of this connector part 70 is largely similar to the design of the connector part 50. It is likewise provided with a radial seal 77, which is pushed onto the socket housing 71 from below. On the side, the socket housing has latching edges 73 on which the latching hooks 45 of the enveloping housing 40 can lock home. The hooks 72 provided for coding are arranged over the latching edges 73. At the end face, the socket housing 71 has two openings 75 through which a slide 76 can be pushed in for secondary securing of the contacts located in the socket housing 71. The socket housing 71 likewise has a cable tie 74 which permits the connecting lead to be fixed once or twice.

The socket housing 71 is sealed from above by means of a covering cap 81. However, for sealing purposes a sealing element 78, here a gel sealing cushion, above which there is a hold-down plate 79, is arranged between the top side of the socket housing 71 and the covering cap 81. The gel sealing cushion 78 is fixed by the hold-down plate 79. Moreover, the hold-down plate 79 ensures that the gel volume present is displaced in a defined fashion in order to be able to ensure the connector part 70 is securely sealed. In order to ensure that the contact elements are plugged in an orientated fashion, the hold-down plate 79 is provided with the same opening contours as the socket housing 71. So as not to be able to insert this hold-down plate 79 the wrong way round into the socket housing 71, said hold-down plate can advantageously be provided with suitable codes, for example rounded and/or snap-on parts.

We claim:

1. An electrical connector coupling, comprising:

a first connector part having a box-shaped enveloping housing and a second connector part to be plugged into said enveloping housing along a given plug-in direction;

said enveloping housing having two mutually opposite double-walled side walls, each of said side walls having an outer wall and an inner wall spaced apart from said outer wall and forming a gap therebetween, each of said inner walls carrying a plurality of latching hooks which are deflectable in a direction towards the respectively associated outer wall when said second connector part is inserted into said enveloping housing;

a substantially U-shaped locking slide for securing said first and second connector parts against accidental separation, said locking slide having two mutually opposite side walls adapted to be inserted perpendicularly to the plug-in direction into said gaps formed in said enveloping housing, said locking slide thereby assuming an intermediate position along an insertion path thereof and, upon further insertion, an end position in which said locking slide secures said first and second connector parts in a proper assembly position thereof;

said mutually opposite side walls of said locking slide having cutouts formed in respective inner wall surfaces thereof, said cutouts, in the intermediate position of said locking slide, coming to lie behind said latching hooks for permitting a deflection of said latching hooks, and said side walls of said locking slide blocking the deflection of said latching hooks in the end position thereof.

2. The connector coupling according to claim 1, wherein said latching hooks are formed with a surface which is beveled in the direction towards said second connector part, and with a surface oriented orthogonally with respect to the plug-in direction.

3. The connector coupling according to claim 1, wherein said latching hooks are formed with a first surface which is beveled in a direction of said second connector part and a second beveled surface.

4. The connector coupling according to claim 1, wherein said second connector part includes a socket housing formed with a latching edge on an outside of said socket housing, said latching edge being adapted to receive and lock against said latching hooks.

5. The connector coupling according to claim 1, wherein said cutouts formed in said inner wall surfaces of said side walls of said locking slide are oblique notches at which said side walls have a relatively reduced thickness.

6. The connector coupling according to claim 1, which further comprises a sliding guide for guiding said locking slide while said locking slide is being inserted into said first connector part.

7. The connector coupling according to claim 6, wherein an outer wall of said first connector part carries pins for said sliding guide of said locking slide.

8. The connector coupling according to claim 6, wherein said mutually opposite side walls of said locking slide are formed with at least one of sliding guide grooves and sliding guide slots in a lower region thereof, and wherein said cutouts are formed in an upper region thereof.

9. The connector coupling according to claim 1, wherein said enveloping housing has latching openings formed therein, and wherein said side walls of said locking slide are formed with latching hooks for latching in said latching openings in said enveloping housing both in the intermediate position and in the end position.

10. The connector coupling according to claim 1, wherein said first connector part includes a base plate and a collared connecting element with a collar projecting from said base plate, said collar being adapted to receive and mount thereon said enveloping housing.

11. The connector coupling according to claim 10, which further comprises sword-shaped elements projecting from said base plate inside said collar for protecting contact pins and contact tubes inside said collar.

12. The connector coupling according to claim 10, which further comprises spring elements projecting inside said collar.

13. The connector coupling according to claim 10, wherein an outer wall of said collar carries pins for said sliding guide of said locking slide.

14. The connector coupling according to claim 1, wherein said second connector part includes a socket housing formed with hooks, said hooks being insertable into recesses formed in said enveloping housing.

15. The connector coupling according to claim 14, wherein said hooks and said recesses are formed with identifying elements.

16. The connector coupling according to claim 1, wherein said second connector part is one of a plurality of second connector parts, and wherein said plurality of second connector parts are pluggable into said enveloping housing.

17. The connector coupling according to claim 1, wherein said cutouts in said mutually opposite side walls of said locking slide are offset relative to one another on said opposite side walls, and wherein said latching hooks on mutually opposite side walls of said enveloping housing are offset relative to one another in correspondence with the offset of said cutouts.

18. The connector coupling according to claim 1, wherein said first connector part is mountable inside a motor vehicle and the connector coupling electrically connects an engine control device to at least one of an ignition module and an engine module.

* * * * *